US008392177B2

(12) United States Patent
Lee et al.

(10) Patent No.: US 8,392,177 B2
(45) Date of Patent: Mar. 5, 2013

(54) METHOD AND APPARATUS FOR FREQUENCY ENCODING, AND METHOD AND APPARATUS FOR FREQUENCY DECODING

(75) Inventors: Nam-suk Lee, Suwon-si (KR); Geon-hyoung Lee, Hwaseong-si (KR); Chul-woo Lee, Suwon-si (KR); Jong-hoon Jeong, Suwon-si (KR); Han-gil Moon, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1068 days.

(21) Appl. No.: 12/363,937

(22) Filed: Feb. 2, 2009

(65) Prior Publication Data

US 2009/0198489 A1 Aug. 6, 2009

(30) Foreign Application Priority Data

Feb. 1, 2008 (KR) ..... 10-2008-0010792

(51) Int. Cl.
*G10L 19/14* (2006.01)

(52) U.S. Cl. ..... 704/205; 704/206; 704/500; 704/502; 704/503; 704/504

(58) Field of Classification Search ..... None
See application file for complete search history.

(56) References Cited

U.S. PATENT DOCUMENTS 5,956,674 A 9/1999 Smyth et al.
6,243,672 B1 * 6/2001 Iijima et al. ..... 704/207
6,266,644 B1 * 7/2001 Levine ..... 704/503
7,120,587 B2 10/2006 Heusdens et al.
7,146,324 B2 * 12/2006 Den Brinker et al. ..... 704/500
7,587,313 B2 * 9/2009 Gerrits et al. ..... 704/211
2005/0195981 A1 9/2005 Faller et al.
2005/0259822 A1 * 11/2005 Sluijter et al. ..... 380/236
2007/0112573 A1 * 5/2007 Gerrits et al. ..... 704/501
2007/0185707 A1 * 8/2007 Gerrits et al. ..... 704/201

FOREIGN PATENT DOCUMENTS

KR 10-0717598 B1 5/2007

OTHER PUBLICATIONS

Fek, Mark, et al. "Joint Speech and Audio Coding Combining Sinusoidal Modeling and Wavelet Packets" Eurospeech, 2001, 4 pages.

* cited by examiner

*Primary Examiner* — Leonard Saint Cyr
(74) *Attorney, Agent, or Firm* — Sughrue Mion, PLLC

(57) ABSTRACT

Provided are a method and apparatus for encoding the frequency of a continuation sinusoidal signal and a method and apparatus for decoding the same. In the encoding method, a continuation sinusoidal signal successive to a sinusoidal signal in a previous section is extracted from a current section; a frequency of the continuation sinusoidal signal at the boundary between the current and previous sections is changed to a first frequency, based on representative frequencies of the continuation sinusoidal signal and at least one sinusoidal signal that belongs to a section adjacent to the current section and is successive to the continuation sinusoidal signal; and the first frequency is encoded.

24 Claims, 9 Drawing Sheets

METHOD AND APPARATUS FOR FREQUENCY ENCODING, AND METHOD AND APPARATUS FOR FREQUENCY DECODING

CROSS-REFERENCE TO RELATED PATENT APPLICATIONS

This application claims priority from Korean Patent Application No. 10-2008-0010792, filed on Feb. 1, 2008 in the Korean Intellectual Property Office, the disclosure of which is incorporated herein in its entirety by reference.

BACKGROUND OF THE INVENTION

1. Field of the Invention

Methods and apparatuses consistent with the present invention relate to frequency encoding, and more particularly, to frequency encoding and decoding which use parametric coding.

2. Description of the Related Art

Parametric coding is a method of expressing an audio signal with specific parameters. Parametric coding has been used in the MPEG-4 (Moving Picture Experts Group 4) standards.

In parametric coding, a sinusoidal component, a transient component, and noise are extracted from an audio signal, parameters thereof are determined, and a bitstream containing the parameters is generated.

If the sinusoidal component is extracted, sinusoidal tracking is performed in order to perform adaptive differential pulse code modulation (ADPCM) or DPCM on the sinusoidal component. In sinusoidal tracking, a sinusoidal signal successive to a sinusoidal signal in a previous or subsequent frame is detected from a current frame and then a correlation between the sinusoidal signals is determined.

A sinusoidal signal in a current frame that cannot be tracked from a sinusoidal signal in a previous frame is referred to as a birth sinusoidal signal or a birth partial. The birth sinusoidal signal is not successive to the sinusoidal signal in the previous frame but is newly generated in the current frame. Absolute coding must be performed on the birth sinusoidal signal instead of difference coding using the sinusoidal signal in the previous frame. For this reason, a large number of bits are needed for coding.

A sinusoidal signal in a current frame that can be tracked from a sinusoidal signal in a previous frame is referred to as a continuation sinusoidal signal or a continuation partial. Since difference coding that uses the sinusoidal signal in the corresponding previous frame can be performed on the continuation sinusoidal signal, coding can be effectively performed.

A sinusoidal signal that disappears without being successive to a sinusoidal signal in a subsequent frame from among continuation sinusoidal signals, is referred to as a death sinusoidal signal or a death partial.

Whether a sinusoidal signal is successive to another sinusoidal signal may be determined by checking whether the difference between the frequencies of the sinusoidal signals is less than or equal to a predetermined value. If the difference is less than or equal to the predetermined value, it is determined that there is continuation between the sinusoidal signals. Such a sinusoidal signal is determined to be a continuation sinusoidal signal and thus, difference coding is performed thereon.

FIG. 1 is a diagram illustrating a related art method of encoding the frequency of a continuation sinusoidal signal.

In the related art method, an audio signal is divided and encoded in units of sections, e.g., frames. Referring to FIG. 1, an audio signal is divided into three frames. The x-axis denotes time (t) and the y-axis denotes frequency (f). A sinusoidal signal in a frame has a representative frequency. Substantially, the frequency of the sinusoidal signal may change within the frame but it is assumed that for efficient encoding, the frequency of the sinusoidal signal does not change within the same frame.

Two birth sinusoidal signals 111 and 121 are present in a first frame. Since absolute coding is performed on the birth sinusoidal signals 111 and 121, the absolute frequencies of the birth sinusoidal signals 111 and 121 are encoded.

Two continuation sinusoidal signals 112 and 122 are present in a second frame. The continuation sinusoidal signals 112 and 122 are respectively encoded using the corresponding sinusoidal signals 111 and 121 in the previous frame. In detail, in the case of the continuation sinusoidal signal 112, the difference D1 between the frequencies of the continuation sinusoidal signal 112 and the corresponding previous sinusoidal signal 111 is encoded. Similarly, in the case of the continuation sinusoidal signal 122, the difference D3 between the frequencies of the continuation sinusoidal signal 122 and the corresponding previous sinusoidal signal 121 is encoded.

If the difference between representative frequencies of sinusoidal signals of the first and second frames is not large, it is possible to transmit the differences D1 and D3. However, if spectral components of sinusoidal signals in frames increase or decrease as illustrated in FIG. 1, the difference between representative frequencies of a sinusoidal signal in a current frame and a corresponding sinusoidal signal in a previous frame is large. In this case, if the frequency of the current sinusoidal signal is encoded using the difference between the frequencies of the current sinusoidal signal and the corresponding previous sinusoidal signal, a large number of bits are needed for the frequency encoding.

SUMMARY OF THE INVENTION

The present invention provides a method and apparatus for performing efficient frequency encoding while using a minimal number of bits, and a method and apparatus for frequency decoding.

According to an aspect of the present invention, there is provided a method of encoding a frequency of a sinusoidal signal by dividing the signal into a plurality of sections, the method comprising: extracting a continuation sinusoidal signal in a current section, which is a sinusoidal signal successive to a sinusoidal signal in a previous section; changing a frequency of the continuation sinusoidal signal at the boundary between the current and previous sections to a first frequency, based on a representative frequency of the continuation sinusoidal signal and a representative frequency of at least one sinusoidal signal which belongs to a section adjacent to the current section and is successive to the continuation sinusoidal signal; and encoding the first frequency.

The method may further comprise changing a frequency of a previous sinusoidal signal at the boundary between the current and previous sections to a second frequency, based on a representative frequency of the previous sinusoidal signal and a representative frequency of at least one sinusoidal signal which belongs to a section adjacent to the previous section and is successive to the previous sinusoidal signal, wherein the previous sinusoidal belongs to the previous section and is successive to the continuation sinusoidal signal, wherein the encoding of the first frequency comprises calculating the difference between the first frequency and the second frequency.

The changing of the frequency of the continuation sinusoidal signal may comprise: determining an estimated parameter representing a relationship between the representative frequency of the continuation sinusoidal signal and a representative frequency of at least one sinusoidal signal which belongs to a section adjacent to the current section and is successive to the continuation sinusoidal signal; and calculating the first frequency by using the estimated parameter and the representative frequency of the continuation sinusoidal signal.

The estimated parameter may comprise a frequency gradient calculated by dividing the difference between the representative frequencies of the previous sinusoidal signal and the continuation sinusoidal signal by a number of samples within the current section.

The estimated parameter may comprise a frequency gradient calculated by dividing the difference between a representative frequency of a subsequent sinusoidal signal and the representative frequency of the continuation sinusoidal signal by a number of samples within the current section, where the subsequent sinusoidal signal belongs to a subsequent section adjacent to the current section and is successive to the continuation sinusoidal signal.

The method may comprise transmitting at least one of encoding mode information indicating encoding method of the representative frequency of the continuation sinusoidal signal, the difference, and the estimated parameter.

The extracting of the continuation sinusoidal signal may comprise extracting a plurality of continuation sinusoidal signals from the current section, where the continuation sinusoidal signals are respectively successive to a plurality of sinusoidal signals in the previous section, wherein the determining of the estimated parameter comprises: a plurality of estimated parameters which respectively correspond to the continuation sinusoidal signals; and determining a representative parameter that is to be commonly used for changing frequencies of the respective sinusoidal signals at the boundary by using the estimated parameters.

The method may further comprise extracting sinusoidal signals from the current section by analyzing an audio signal, wherein the extracting of the continuation sinusoidal signal comprises performing sinusoidal tracking on the extracted sinusoidal signals.

According to another aspect of the present invention, there is provided a method of decoding a representative frequency of a continuation sinusoidal signal in a current section, which is successive to a sinusoidal signal in a previous section, the method comprising: obtaining first information and second information from an encoded audio signal, where the first information includes information regarding a first frequency that is a frequency of the continuation sinusoidal signal, which is changed at the boundary between the current section and the previous section, and the second information includes information regarding a relationship between the first frequency and the representative frequency; calculating the first frequency by using the first information; and restoring the representative frequency by using the first frequency and the second information.

The first information may be the difference between the first frequency and a second frequency that is a frequency of a previous sinusoidal signal, which is changed at the boundary, and the previous sinusoidal signal may belong to the previous section and is successive to the continuation sinusoidal signal.

The second information may comprise a frequency gradient calculated by dividing the difference between a representative frequency of the previous sinusoidal signal and the representative frequency of the continuation sinusoidal signal by a number of samples within the current section, where the previous sinusoidal signal belongs to the previous section and is successive to the continuation sinusoidal signal.

The second information may comprise a frequency gradient calculated by dividing the difference between a representative frequency of a subsequent sinusoidal signal and the representative frequency of the continuation sinusoidal signal by a number of samples within the current section, where the subsequent sinusoidal signal belongs to a subsequent section adjacent to the current section and is successive to the continuation sinusoidal signal.

According to another aspect of the present invention, there is provided an apparatus for encoding a frequency of a sinusoidal signal by dividing the signal into a plurality of sections, the apparatus comprising: a continuation sinusoidal signal extraction unit extracting a continuation sinusoidal signal in a current section, which is a sinusoidal signal successive to a sinusoidal signal in a previous section; a frequency changing unit changing a frequency of the continuation sinusoidal signal at the boundary between the current and previous sections to a first frequency, based on a representative frequency of the continuation sinusoidal signal and a representative frequency of at least one sinusoidal signal which belongs to a section adjacent to the current section and is successive to the continuation sinusoidal signal; and an encoding unit encoding the first frequency.

According to another aspect of the present invention, there is provided an apparatus for decoding a representative frequency of a continuation sinusoidal signal in a current section, which is successive to a sinusoidal signal in a previous section, the apparatus comprising: an information obtaining unit obtaining first information and second information from an encoded audio signal, where the first information includes information regarding a first frequency that is a frequency of the continuation sinusoidal signal, which is changed at the boundary between the current section and the previous section, and the second information includes information regarding a relationship between the first frequency and the representative frequency; a frequency calculating unit calculating the first frequency by using the first information; and a frequency restoring unit restoring the representative frequency by using the first frequency and the second information.

BRIEF DESCRIPTION OF THE DRAWINGS

The above and other aspects of the present invention will become more apparent by describing in detail exemplary embodiments thereof with reference to the attached drawings in which.

DETAILED DESCRIPTION OF EXEMPLARY EMBODIMENTS OF THE INVENTION

Exemplary embodiments of the present invention will now be described in greater detail with reference to the accompanying drawings.

Figure 1:
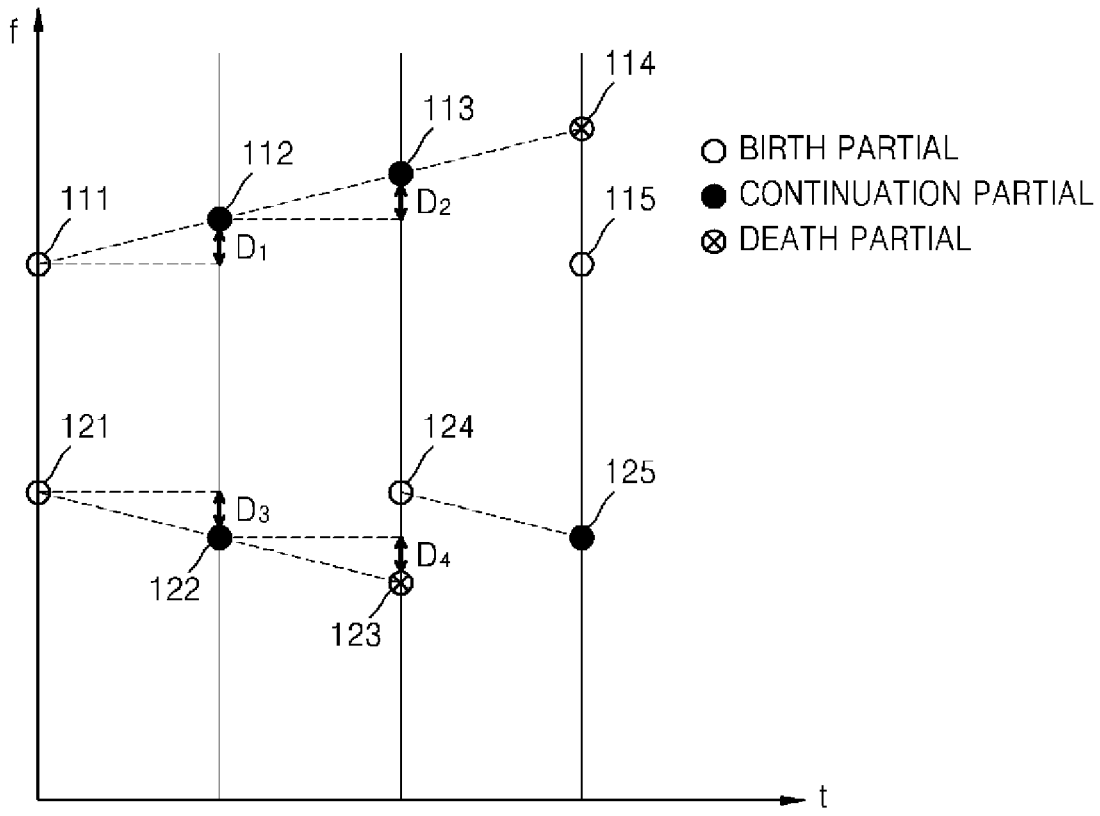
FIG. 1 (RELATED ART)
FIG. 1 is a diagram illustrating a related art method of encoding the frequency of a continuation sinusoidal signal.
Figure 2:
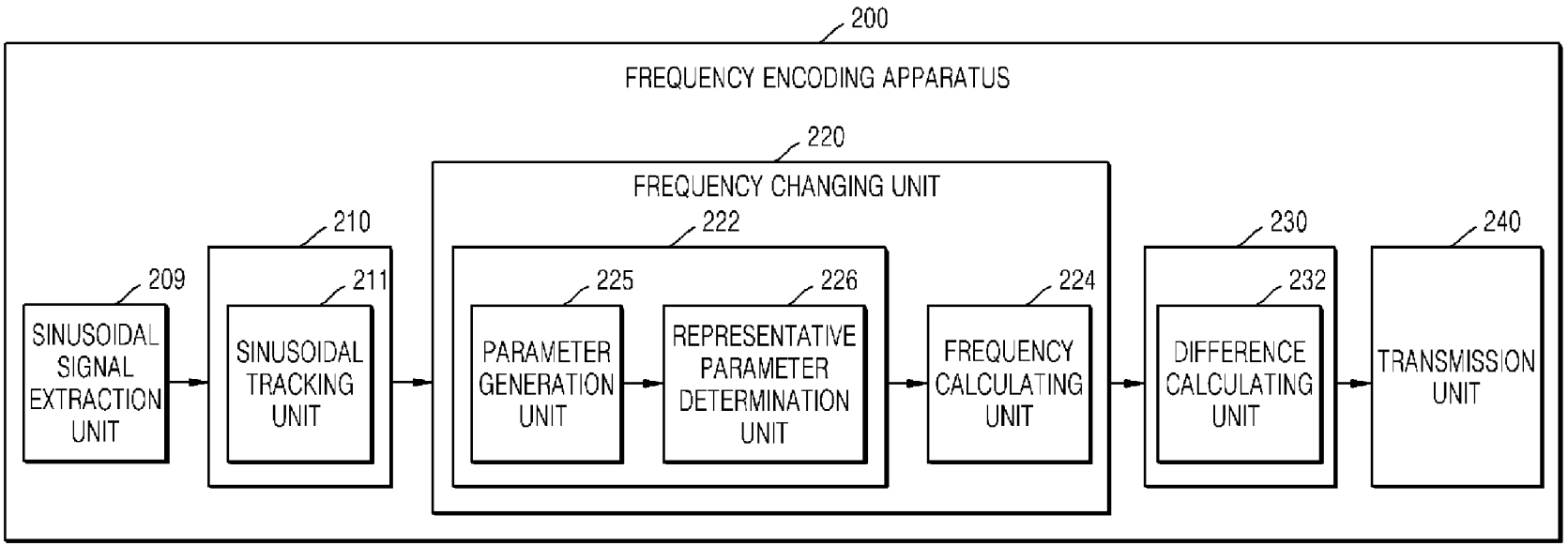
FIG. 2 is a block diagram of a frequency encoding apparatus according to an exemplary embodiment of the present invention.

FIG. 2 is a block diagram of a frequency encoding apparatus 200 according to an exemplary embodiment of the present invention. The frequency encoding apparatus 200 includes a continuation sinusoidal signal extraction unit 210, a frequency changing unit 220, and an encoding unit 230. The frequency encoding apparatus 200 divides a sinusoidal signal into a plurality of sections and encodes the frequency of the sinusoidal signal in section units. In the present specification, a section may be referred to as a frame according to an exemplary embodiment of the present invention.

The continuation sinusoidal signal extraction unit 210 extracts a continuation sinusoidal signal in a current section, which is a sinusoidal signal successive to a sinusoidal signal in a previous section. In parametric coding, an audio signal is divided into a transient signal, a sinusoidal signal and a noise signal and then these signals are encoded. The frequency encoding apparatus 200 further includes a sinusoidal signal extraction unit (209) that analyzes an audio signal and extracts a sinusoidal signal from the current section, or else, receives information regarding extraction of a sinusoidal signal from a previous module.

The continuation sinusoidal signal extraction unit 210 may include a tracking unit (211). The tracking unit extracts a continuation sinusoidal signal by performing sinusoidal tracking on the sinusoidal signal in the current section. In the exemplary embodiments of the present specification, a continuation sinusoidal signal is a sinusoidal signal in a current section, which is successive to a sinusoidal signal in a previous section. A death sinusoidal signal is also a continuation sinusoidal signal.

The frequency changing unit 220 extracts the representative frequencies of the continuation sinusoidal signal in the current section and at least one sinusoidal signal that belongs to sections adjacent to the current section and is successive to the continuation sinusoidal signal in the current section. The adjacent sections include a previous section immediately before the current section and a subsequent section immediately after the current section. Hereinafter, a signal that belongs to a previous section and is successive to a continuation sinusoidal signal in a current section will be referred to as a "previous sinusoidal signal", and a signal that belongs to a subsequent section and is successive to the continuation sinusoidal signal in the current section will be referred to as a "subsequent sinusoidal signal".

The frequency of the continuation sinusoidal signal at the boundary between the current section and the previous section is converted into a first frequency, based on the extracted representative frequencies. It is assumed that for efficient encoding, a continuation sinusoidal signal has one representative frequency within a section but the frequency of the continuation signal substantially changes within the section. In this case, the trend in a frequency change in an adjacent section is detected using the representative frequencies of a continuous sinusoidal signal in the adjacent section, and the frequency of the continuation sinusoidal signal at the start of the current section is changed based on the detected trend.

An estimated parameter may be used as a value representing the trend in a frequency change of a sinusoidal signal in the adjacent section. In this case, the frequency changing unit 220 includes a parameter determination unit 222 and a frequency calculating unit 224.

The parameter determination unit 222 determines an estimated parameter representing the relationship between the representative frequencies of the continuation sinusoidal signal in the current section and the sinusoidal signal that belongs to the adjacent section and is successive to the continuation sinusoidal signal in the current section.

An example of the estimated parameter will now be described. However, the estimated parameter is not limited to the following description and may be any value representing the trend in a change in the frequency of a sinusoidal signal in an adjacent section.

The estimated parameter may be determined using the representative frequencies of the continuation sinusoidal signal in the current section and the sinusoidal signal in a previous section. For example, a frequency gradient obtained by dividing the difference between the representative frequencies of the continuation sinusoidal signal in the current section and a previous sinusoidal signal by the number of samples is determined to be the estimated parameter. In this case, the estimated parameter is generated by Equation (1) as follows:

$$b_n = \frac{f_n - f_{n-1}}{S}, \tag{1}$$

wherein $b_n$ denotes the estimated parameter, $f_n$ denotes the representative frequency of the continuation sinusoidal signal in the current section, $f_{n-1}$ denotes the representative frequency of the previous sinusoidal signal, S denotes the number of samples in a current section, and n is an integer denoting a section number.

The estimated parameter may also be determined using the representative frequencies of the continuation sinusoidal signal in the current section and a subsequent sinusoidal signal. For example, a frequency gradient obtained by dividing the difference between the representative frequencies of the continuation sinusoidal signal in the current section and the subsequent sinusoidal signal by the number of samples is determined to be the estimated parameter. In this case, the estimated parameter is generated by Equation (2) as follows:

$$b_n = \frac{f_{n+1} - f_n}{S}, \tag{2}$$

wherein $b_n$ denotes the estimated parameter, $f_n$ denotes the representative frequency of the continuation sinusoidal signal in the current section, $f_{n+1}$ denotes the representative frequency of the subsequent sinusoidal signal, and S denotes the number of samples in the current section.

Also, the estimated parameter may be determined by multiplying the frequency gradient calculated using Equation (1) or (2) by the representative frequency of the continuation sinusoidal signal, as follows in Equation (3):

$$b_n = \frac{f_{n+1} - f_n}{S} f_n, \tag{3}$$

wherein $b_n$ denotes the estimated parameter, $f_n$ denotes the representative frequency of the continuation sinusoidal signal in the current section, $f_{n+1}$ denotes the representative frequency of the subsequent sinusoidal signal, and S denotes the number of samples in the current section.

Alternatively, the estimated parameter may be determined by setting a secondary function covering all the representative frequencies of the previous sinusoidal signal, the continuation sinusoidal signal in the current section, and the subsequent sinusoidal signal and then determining the coefficient of the secondary function to be the estimated parameter. As described above, the estimated parameter may have various formats, including a constant, constant×frequency, and constant+constant×frequency.

After the estimated parameter is determined as described above, the frequency calculating unit 224 calculates the first frequency by using the estimated parameter and the representative frequency of the continuation sinusoidal signal in the current section, where the first frequency is the frequency of the continuation sinusoidal signal at the start of the current section. A method of calculating the first frequency depends on the format of the estimated parameter, and thus, the frequency encoding apparatus 200 must determine the type of estimated parameter to be used for encoding or transmit information regarding the types of estimated parameters used in section units, prior to calculating the first frequency.

A case where the estimated parameter is determined by using Equation (1) or (2) will first be described. In this case, it is assumed that a sinusoidal signal at the middle of a section has a representative frequency $f_n$. The estimated parameter $b_n$ determined by using Equation (1) or (2) is a variation in frequency per unit sample. Thus, the first frequency $f'_n$ that is a frequency of continuation sinusoidal signal, which is changed at the start of the current section, is calculated by $f_n - b_n*S/2$. Similarly, a frequency $f''_n$ of the continuation sinusoidal signal, which is changed at the end of the current section, is calculated by $f_n + b_n*S/2$. For example, it is assumed that the continuation sinusoidal signal in the current section has a representative frequency of 10 kHz; the estimated parameter $b_n$ is 0.001 kHz/sample, and the number S of samples in the current section is 1024. In this case, the frequency calculating unit 224 calculates the frequency of the continuation sinusoidal signal at the start of the current section to be 10 kHz−0.001*1024/2=9.488 kHz. Also, the frequency of the continuation sinusoidal signal at the end of the current section is 10 kHz+0.001*1024/2=10.512 kHz.

Next, a case where the estimated parameter is determined by using Equation (3) will be described. In this case, the continuation sinusoidal signal has a frequency $f'_n = 1 - b_n*S/2*f_n$ at the start of the current section, and a frequency $f''_n = 1 + b_n*S/2*f_n$ at the end of the current section.

Likewise, the frequency encoding apparatus 200 changes the frequencies of sinusoidal signals at the boundaries of the other sections. Accordingly, the frequency changing unit 220 changes the frequency of the previous sinusoidal signal at the start and end of the previous section, based on the representative frequencies of the previous sinusoidal signal that is successive to the continuation sinusoidal signal and belongs to the previous section and at least one sinusoidal signal that is successive to the previous sinusoidal signal and belongs to a section adjacent to the previous section. The parameter determination unit 222 determines an estimated parameter corresponding to the previous section, and the frequency calculating unit 224 calculates a frequency $f'_{n-1}$ of the previous sinusoidal signal, which was changed at the start of the previous section, and a frequency $f''_{n-1}$ of the previous sinusoidal signal, which was changed at the end of the previous section, based on the corresponding estimated parameter. Hereinafter, a frequency $f''_{n-1}$ of a previous sinusoidal signal, which was changed at the end of a previous section, will be referred to as a "second frequency".

The encoding unit 230 encodes the first frequency that is a frequency of the continuation sinusoidal signal, which is changed at the boundary between the previous section and the current section. The encoding unit 230 encodes the difference between the first frequency and the second frequency. The encoding unit 230 may include a difference calculator 232 that calculates the difference between the first and second frequencies. The difference calculator 232 calculates the difference $d'_n$ between the first and second frequencies by $d'_n = f'_n - f''_{n-1}$.

In the current section, one continuation sinusoidal signal may exist but a plurality of continuation sinusoidal signals may also coexist. If a plurality of continuation sinusoidal signals are present in the current section, the continuation sinusoidal signal extraction unit 210 extracts a plurality of continuation sinusoidal signals in the current section that are respectively successive to a plurality of sinusoidal signals in the previous section. The parameter determination unit 222 calculates an estimated parameter of each of the extracted continuation sinusoidal signals, and the frequency calculating unit 224 changes the frequency of each of the extracted continuation sinusoidal signals by using the corresponding estimated parameter. However, if frequency changes in the continuation sinusoidal signals in the current section show a similar trend, it is probably efficient to change all the frequencies of the continuation sinusoidal signals by using one parameter.

In this case, the parameter determination unit 222 may further include a representative parameter determination unit (226). The representative parameter determination unit determines a representative parameter that is to be commonly applied to all the continuation sinusoidal signals in the current section, based on the parameters. The representative parameter may be the average of the parameters or may be an intermediate value selected from among the parameters.

The frequency encoding apparatus 200 may further include a transmission unit (240) that transmits at least one of the differences $d'_n$ between the first and second frequencies and the estimated parameter. In some cases, there may be a section in which frequency encoding is performed according to a related art method, and thus, the transmission unit preferably further transmits encoding mode information indicating a method according to which the current section has been encoded.

FIGS. 3A through 3D are graphs illustrating encoding of the frequency of a continuation sinusoidal signal by using the frequency encoding apparatus 200, according to exemplary embodiments of the present invention.

Figure 3A:
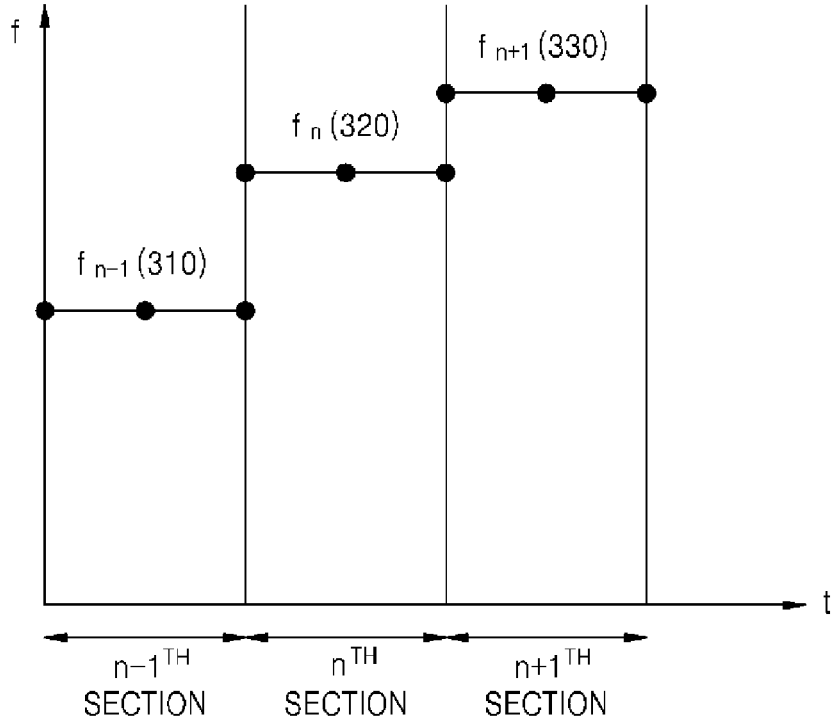
FIGS. 3A through 3D are graphs illustrating encoding of the frequency of a continuation sinusoidal signal by using the frequency encoding apparatus illustrated in FIG. 2, according to exemplary embodiments of the present invention.

FIG. 3A is a graph illustrating the frequencies of a previous sinusoidal signal, a continuation sinusoidal signal and a subsequent sinusoidal signal that are present in three adjacent sections and are successive to one another. In FIG. 3A, the x-axis denotes time and the y-axis denotes frequency. Also, an $n-1^{th}$ section is a previous section, an $n^{th}$ section is a current section, and an $n+1^{th}$ section is a subsequent section. The frequencies of the previous sinusoidal signal, the continuation sinusoidal signal and the subsequent sinusoidal signal are denoted by $f_{n-1}$(310), $f_n$(320) and $f_{n+1}$(330), respectively. It is assumed that the number of times sampling was performed is S and the representative frequency of each signal is obtained through $S/2^{th}$ sampling. In the related art, the difference $d_n=f_n$(320)$-f_{n-1}$(310) is transmitted in order to encode the representative frequency $f_n$(320) in the current section.

Figure 3B:
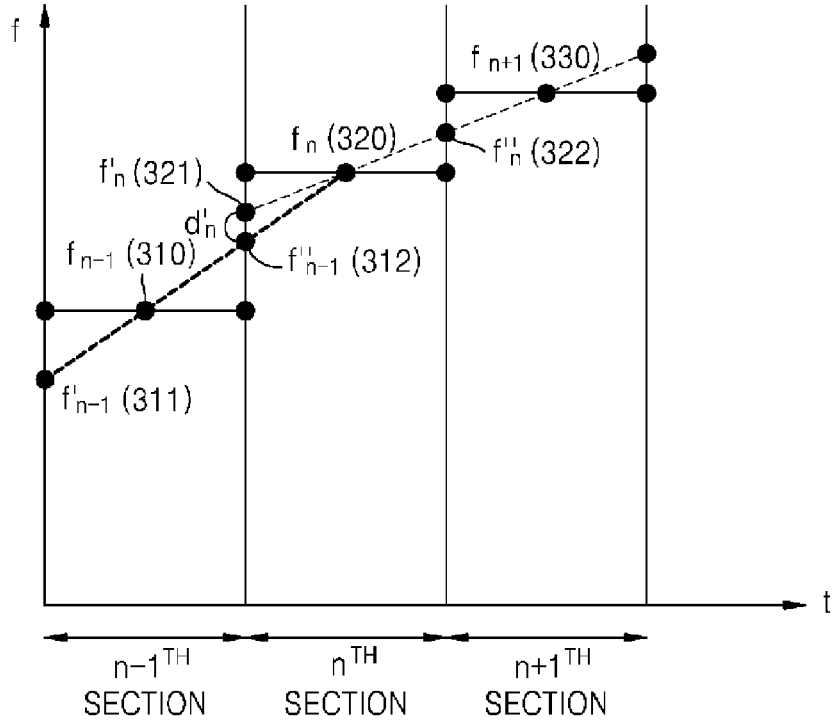

FIG. 3B is a graph illustrating encoding of the frequency of the continuation sinusoidal signal in the current section based on the trend of a frequency change between the current section and the subsequent section, according to an exemplary embodiment of the present invention.

An estimated parameter of the current section is calculated by using Equation (2). That is, a frequency gradient calculated by subtracting the representative frequency $f_n$(320) of the continuation sinusoidal signal from the representative frequency $f_{n+1}$(330) of the subsequent sinusoidal signal and then dividing the resultant value by the number of samples per section S, is the estimated parameter of the current section. The frequency of the continuation sinusoidal signal is changed at the start and end of the current section by using the determined estimated parameter.

Referring to FIG. 3B, a frequency $f''_n$(322), where the line connecting the representative frequencies $f_n$(320) and $f_{n+1}$(330) intersects the boundary between the current section and the subsequent section, is a frequency of the continuation sinusoidal signal, which is changed at the end of the current section. Also, a frequency $f'_n$(321), where the line connecting the representative frequencies $f_n$(320) and $f_{n+1}$(330) intersects the boundary between the previous section and the current section, is a frequency of the continuation sinusoidal signal, which is changed at the start of the current section.

Similarly, a frequency gradient obtained by subtracting the representative frequency $f_{n-1}$(310) from the representative frequency $f_n$(320) and dividing the resultant value by the number S of samples in the section, is the estimated parameter of the previous section.

Referring to FIG. 3B, a frequency $f''_{n-1}$(312), where the line connecting the representative frequencies $f_{n-1}$(310) and $f_n$(320) intersects the boundary between the previous section and the current section, is a frequency of the previous sinusoidal signal, which is changed at the end of the previous section. Also, a frequency $f'_{n-1}$(311), where the line connecting the representative frequencies $f_{n-1}$(310) and $f_n$(320) intersects the boundary between the previous section and a section ($N-2^{th}$ section) immediately before the previous section, is the frequency of the previous sinusoidal signal, which is changed at the start of the previous section.

The difference calculator 232 calculates the difference $d'_n=f'_n$(321)$-f''_{n-1}$(312), and the encoding unit 230 generates a bitstream by quantizing the difference $d'_n$. Since the difference $d'_n$ is smaller than the difference $d_n$, frequency encoding can be efficiently performed using a minimal number of bits.

Figure 3C:
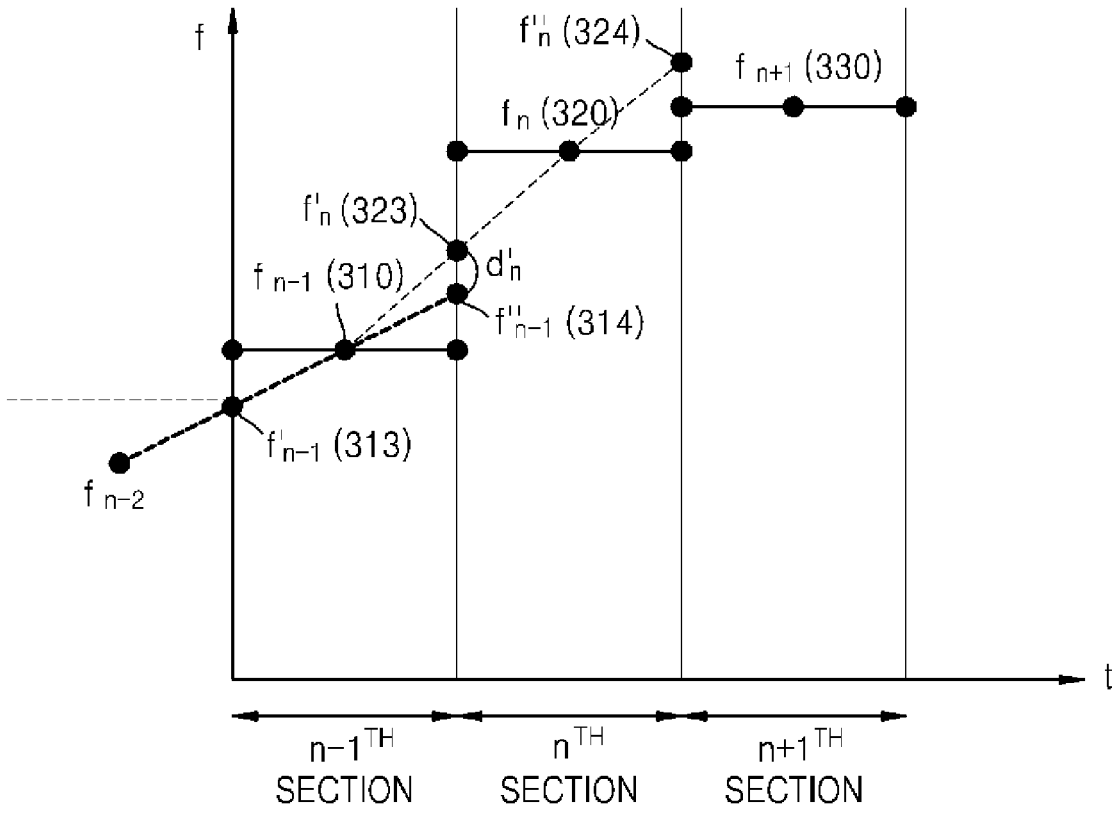

FIG. 3C is a graph illustrating encoding of the frequency of the continuation sinusoidal signal in the current section by using the trend of a frequency change between the previous section and the current section, according to an exemplary embodiment of the present invention.

An estimated parameter of the current section is calculated by using Equation (1). That is, a frequency gradient obtained by subtracting the representative frequency $f_{n-1}$(310) of a previous sinusoidal signal from the representative frequency $f_n$(320) of the continuation sinusoidal signal and dividing the resultant value by the number S of samples in the section, is the estimated parameter of the current section. The frequency of the continuation sinusoidal signal is changed at the start and end of the current section by using the estimated parameter.

Referring to FIG. 3C, a frequency $f''_n$324, where the line connecting the representative frequencies $f_n$(320) and $f_{n-1}$(310) intersects the boundary between the current section and the subsequent section, is a frequency of the continuation sinusoidal signal, which is changed at the end of the current section. Also, a frequency $f'_n$(323), where the line connecting the representative frequencies $f_n$(320) and $f_{n-1}$(310) intersects the boundary between the previous section and the current section, is a frequency of the continuation sinusoidal signal, which is changed at the start of the current section.

Similarly, a frequency of the previous sinusoidal signal, which is changed at the start of the previous section, is $f'_{n-1}$(313) and a frequency of the previous sinusoidal signal, which is changed at the end of the previous section, is $f''_{n-1}$(314).

The difference calculator 232 calculates the difference $d'_n=f'_n$(323)$-f''_{n-1}$(314) and the encoding unit 230 generates a bitstream by quantizing the difference $d'_n$. In this case, since the difference $d'_n$ is also smaller than the difference $d_n$, frequency encoding can be efficiently performed using a minimal number of bits.

Figure 3D:
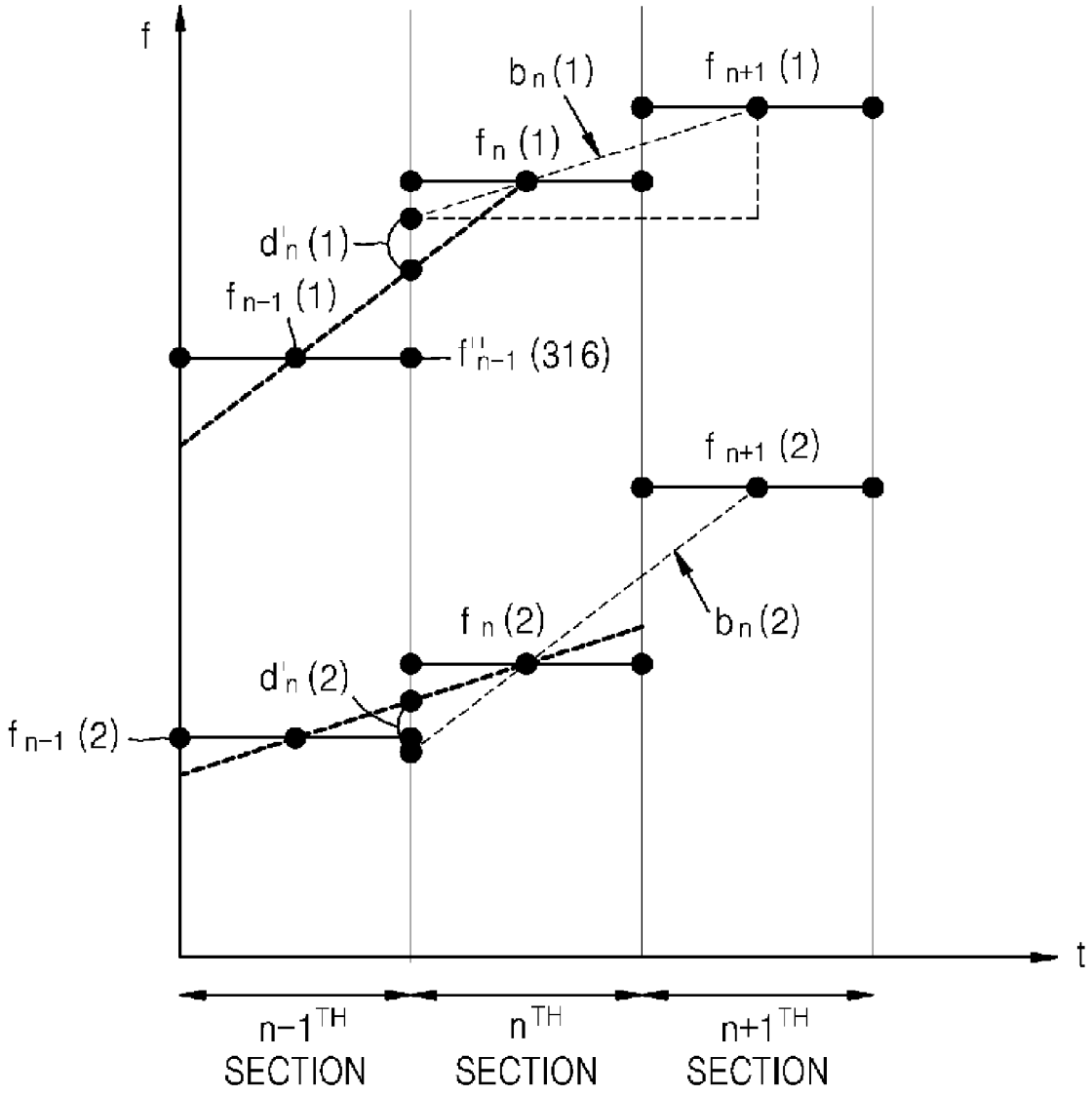

FIG. 3D is a graph illustrating encoding of the frequencies of continuation sinusoidal signals in a current section according to an exemplary embodiment of the present invention.

Two continuation sinusoidal signals are present in a current section, and the representative frequencies of the continuation sinusoidal signals are respectively $f_n(1)$ and $f_n(2)$. Estimated parameters of the current section are calculated by using Equation (2). In this case, the calculated estimated parameters are $b_n(1)$ and $b_n(2)$. The differences $d'_n(1)$ and $d'_n(2)$ of frequencies of the continuation sinusoidal signals may be calculated using the estimated parameters $b_n(1)$ and $b_n(2)$ but may also be calculated using one representative parameter. In the latter case, a representative parameter determination unit (226) determines a representative parameter by using the estimated parameters $b_n(1)$ and $b_n(2)$, and the frequency calculating unit 224 calculates frequencies of the continuation sinusoidal signals, which are changed at the start and end of the current section, by using the representative parameter.

Figure 4:
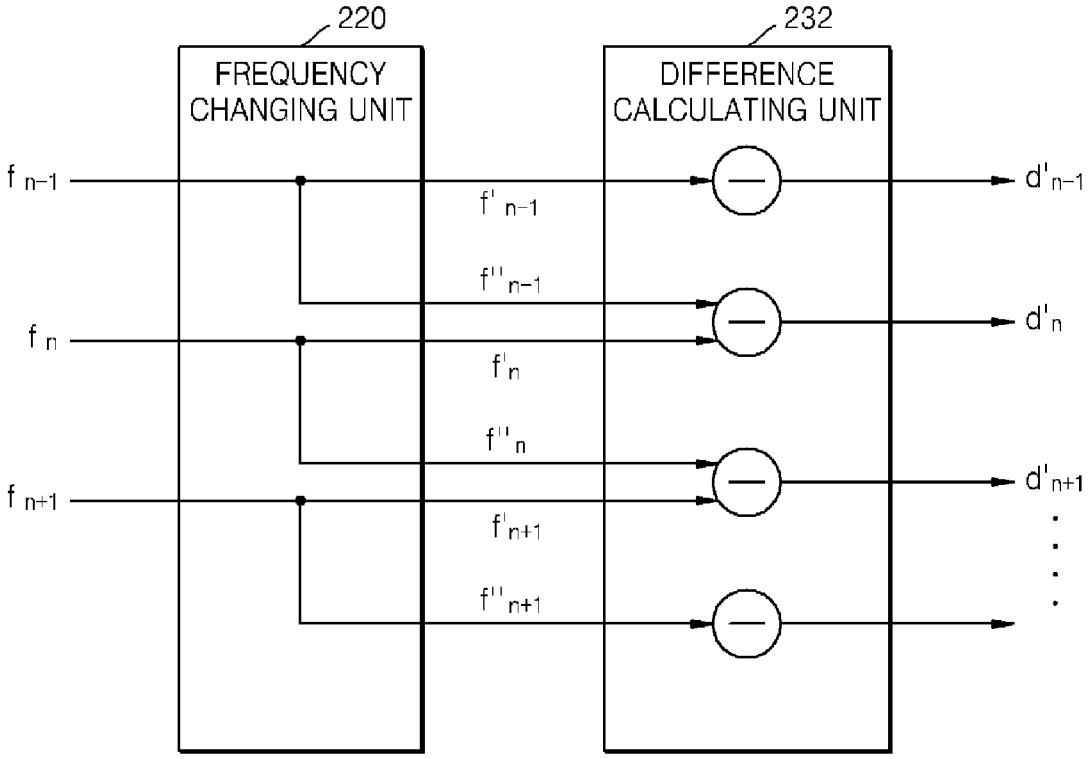
FIG. 4 is a diagram illustrating a process of calculating the difference between changed frequencies according to an exemplary embodiment of the present invention.

FIG. 4 is a diagram illustrating a process of calculating the difference between changed frequencies according to an exemplary embodiment of the present invention.

In FIG. 4, the representative frequency of a previous sinusoidal signal is denoted by $f_{n-1}$. The frequency changing unit 220 of FIG. 2 changes the frequency $f_{n-1}$ of the previous sinusoidal signal to be respectively $f'_{n-1}$ and $f''_{n-1}$ at the start and end of a previous section by using an estimated parameter corresponding to the previous section.

The representative frequency of a continuation sinusoidal signal in a current section is denoted by $f_n$. The frequency changing unit 220 changes the frequency $f_n$ of the continuation sinusoidal signal to be respectively $f'_n$ and $f''_n$ at the start and end of the current section by using an estimated parameter corresponding to the current section. The difference calculator 232 calculates the difference $d'_n$ between the frequencies $f'_n$ and $f''_{n-1}$.

The representative frequency of a subsequent sinusoidal signal is denoted by $f_{n+1}$. Similarly, the frequency changing unit 220 calculates frequencies $f'_{n+1}$ and $f''_{n+1}$, and the difference calculator 232 calculates the difference $d'_{n+1}$ between the frequencies $f'_{n+1}$ and $f''_n$. As described above, difference coding is performed on all sections by using changed frequencies thereof.

Figure 5:
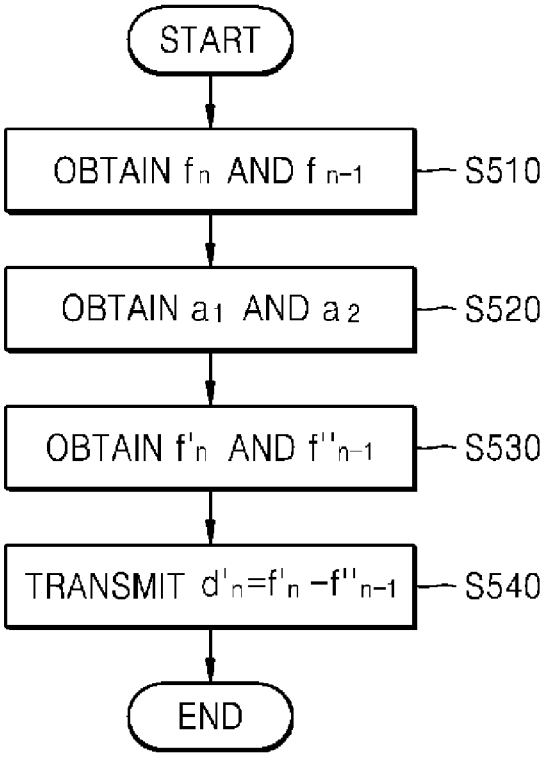
FIG. 5 is a flowchart illustrating a frequency encoding method according to an exemplary embodiment of the present invention.

FIG. 5 is a flowchart illustrating a frequency encoding method according to an exemplary embodiment of the present invention.

In operation S510, a continuation sinusoidal signal is extracted from a current section, and the representative frequency of the continuation sinusoidal signal is obtained. Here, the continuation sinusoidal signal in the current section is p(n) and a previous sinusoidal signal is p(n−1). Also, the representative frequency of the continuation sinusoidal signal p(n) is $f_n$ and the representative frequency of the previous p(n−1) is $f_{n-1}$.

In operation S520, an estimated parameter $a_1$ corresponding to a previous section and an estimated parameter $a_2$ corresponding to the current section are calculated using Equations (1) or (2).

In operation S530, the frequency of the continuation sinusoidal signal p(n) at the start of the current section is changed to $f'_n$ by using the representative frequency $f_n$ and the estimated parameter $a_2$, and the frequency of the previous sinusoidal signal p(n−1) at the end of the previous section is changed to $f''_{n-1}$ by using the representative frequency $f_{n-1}$ and the estimated parameter $a_1$.

In operation S540, difference coding is performed using the frequencies $f'_n$ and $f''_{n-1}$. That is, $d'_n=f'_n-f''_{n-1}$ transmitted.

Figure 6:
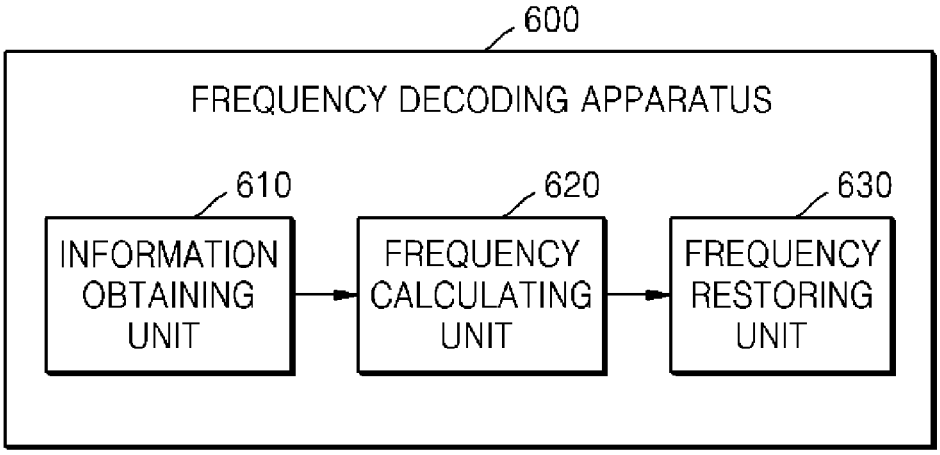
FIG. 6 is a block diagram of a frequency decoding apparatus according to an exemplary embodiment of the present invention.

FIG. 6 is a block diagram of a frequency decoding apparatus 600 according to an exemplary embodiment of the present invention.

The frequency decoding apparatus 600 decodes the representative frequency of a continuation sinusoidal signal in a current section, which is successive to a sinusoidal signal in a previous section. The frequency decoding apparatus 600 includes an information obtaining unit 610, a frequency calculating unit 620, and a frequency restoring unit 630.

The information obtaining unit 610 obtains first information including information regarding a first frequency from an encoded audio signal. The encoded audio signal may be received in the form of a bitstream. The first frequency is a frequency of a continuation sinusoidal signal, which is changed at the start of a current section, and is calculated based on the trend in a frequency change between the current section and a previous section or between the current section and a subsequent section. The first information may include the difference between a second frequency that is a frequency of a previous sinusoidal signal, which is changed at the end of the previous section, and the first frequency.

The information obtaining unit 610 further obtains second information including the relationship between the first frequency and the representative frequency. The second information may include an estimated parameter used in calculating the first frequency. The estimated parameter may be calculated by using various equations, such as Equation (1), (2) or (3). For example, the estimated parameter may be calculated by using Equation (1), and may be a frequency gradient calculated by dividing the difference between the representative frequencies of the continuation sinusoidal signal and the previous sinusoidal signal by the number of samples in a current section. Also, the estimated parameter may be calculated by using Equation (2), and may be a frequency gradient calculated by dividing the difference between the representative frequencies of the continuation sinusoidal signal and a subsequent sinusoidal signal by the number of samples in the current section.

The information obtaining unit 610 may further obtain additional information regarding frequency encoding. The additional information may be any information regarding frequency encoding, such as encoding mode information representing whether the representative frequency of the continuation sinusoidal signal has been encoded according to a related art encoding method or an encoding method according to the present invention, or information regarding the type of estimated parameter.

The frequency calculating unit 620 calculates the first frequency by using the first information. If the first information is the difference $d'_n$ between a first frequency $f'_n$ and a second frequency $f''_{n-1}$, the first frequency $f'_n=d'_n+f''_{n-1}$. In this case, the second frequency $f''_{n-1}$ has already been calculated before decoding the continuation sinusoidal signal in the current section.

The frequency restoring unit 630 restores the representative frequency of the continuation sinusoidal signal in the current section, based on the first frequency and the second information. The frequency restoring unit 630 selects a frequency restoring method depending on the type of estimated parameter used when the representative frequency of the continuation sinusoidal signal was encoded. Thus, the second information may include not only the estimated parameter but also information regarding the type of estimated parameter used for encoding the representative parameter of the continuation sinusoidal signal. If the estimated parameter is calculated by using Equation (1) or (2), the representative frequency $f_n$ of the continuation sinusoidal signal is calculated by $f_n=f'_n+b_n*S/2$, where $b_n$ denotes a frequency gradient in the current section and S denotes the number of samples in the current section. Assuming that the representative frequency is a frequency sample value in the middle of the current section, $b_n*S/2$ is the difference between the first frequency that is a frequency of the continuation sinusoidal signal, which is changed at the start of the current section, and the representative frequency of the continuation sinusoidal signal in the middle of the current section.

The frequency decoding apparatus 600 may further include a preprocessor module, such as a data unpacking unit (not shown) and a dequantizer (not shown), which corresponds to the frequency encoding apparatus 200.

Figure 7:
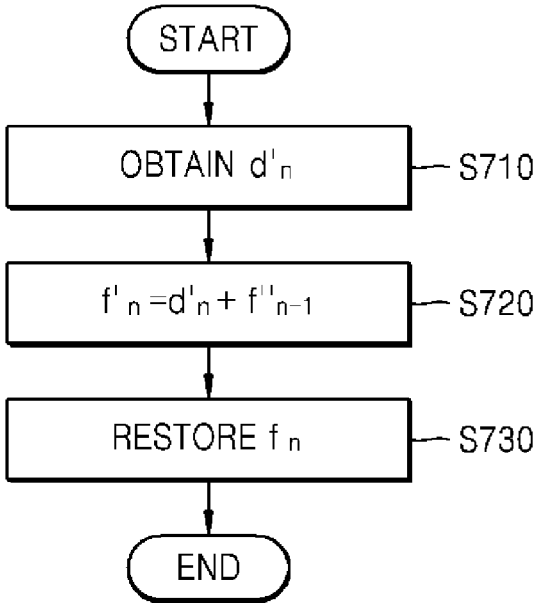
FIG. 7 is a flowchart illustrating a frequency decoding method according to an exemplary embodiment of the present invention.

FIG. 7 is a flowchart illustrating a frequency decoding method according to an exemplary embodiment of the present invention. In FIG. 7, a continuation sinusoidal signal in a current section is p(n) and a previous sinusoidal signal is p(n−1). The representative frequency of the continuation sinusoidal signal p(n) is $f_n$, and the representative frequency of the previous sinusoidal signal p(n−1) is $f_{n-1}$.

In operation S710, $d'_n$ and $a_2$ are obtained by receiving a bitstream including an encoded audio signal, wherein $d'_n$ denotes the difference between a first frequency $f'_n$ that is a frequency of the continuation sinusoidal signal p(n), which is changed at the start of a current section and a second frequency $f''_{n-1}$ that is a frequency of the previous sinusoidal signal p(n−1), which is changed at the end of a previous section, and $a_2$ denotes an estimated parameter in the current section, which is calculated by using Equation (1) or (2).

In operation S720, the first frequency $f'_n$ is calculated by $f'_n=d'_n+f''_{n-1}$. The previous sinusoidal signal p(n−1) has already been decoded prior to decoding the continuation sinusoidal signal in the current section. Thus, the second frequency $f''_{n-1}$ has already been calculated.

In operation S730, the representative frequency $f_n$ of the continuation sinusoidal signal p(n) is restored using the estimated parameter $a_2$ and the first frequency $f'_n$.

Figure 8:
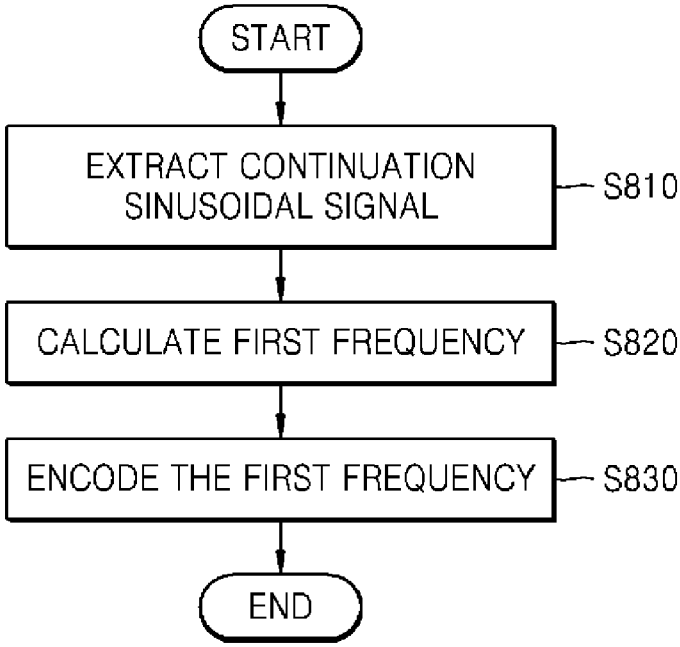
FIG. 8 is a flowchart illustrating a frequency encoding method according to another exemplary embodiment of the present invention.

FIG. 8 is a flowchart illustrating a frequency encoding method according to another exemplary embodiment of the present invention.

In operation S810, a continuation sinusoidal signal that is a sinusoidal signal in a current section, which is successive to a previous sinusoidal signal in a previous section is extracted.

In operation S820, the frequency of the continuation sinusoidal signal at the boundary between the current section and the previous section is changed to a first frequency, based on the representative frequencies of the continuation sinusoidal signal and at least one sinusoidal signal that belongs to a section adjacent to the current section and is successive to the continuation sinusoidal signal.

In order to calculate the first frequency, an estimated parameter representing the relationship between the representative frequencies of the continuation sinusoidal signal and the previous sinusoidal signal or between the representative frequencies of the continuation sinusoidal signal and a subsequent sinusoidal signal is determined. Next, the first frequency is calculated using the estimated parameter and the representative frequency of the sinusoidal signal.

In operation S830, the first frequency is encoded. The first frequency is encoded using difference coding, and the difference between the first frequency and a second frequency that is a frequency of the previous sinusoidal signal, which is changed at the end of the previous section, is encoded.

Figure 9:
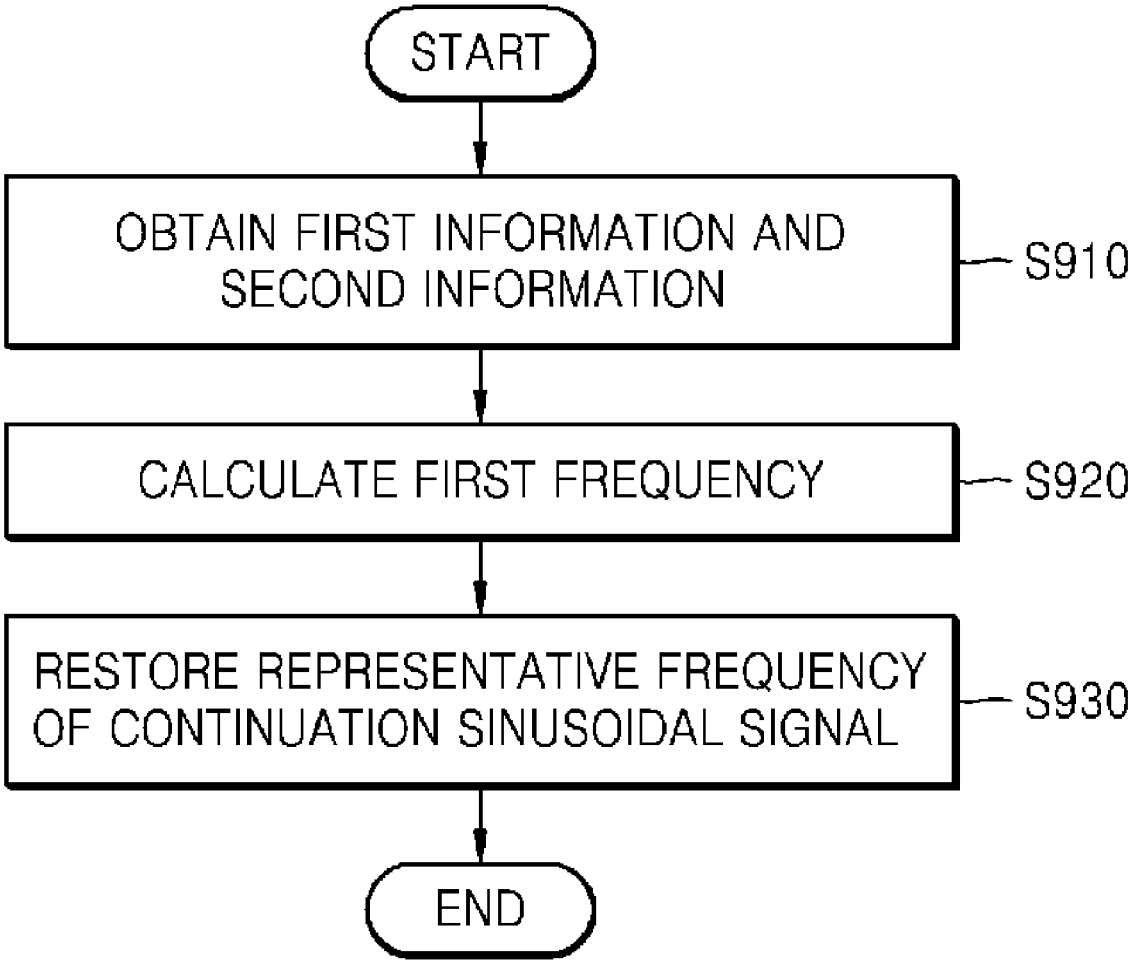
FIG. 9 is a flowchart illustrating a frequency decoding method according to another exemplary embodiment of the present invention.

FIG. 9 is a flowchart illustrating a frequency decoding method according to an exemplary embodiment of the present invention.

In operation S910, first information and second information are obtained from an encoded audio signal. The first information includes information regarding a first frequency that is a frequency of a continuation sinusoidal signal, which is changed at the start of a current section. For example, the information regarding the first frequency may be the difference between the first frequency and a second frequency that is a frequency of a previous sinusoidal signal, which is changed at the end of a previous section.

The second information represents the relationship between the first frequency and the representative frequency. For example, the second information may include an estimated parameter used in calculating the first frequency and information regarding the type of the estimated parameter.

In operation S920, the first frequency is calculated using the first information. If the first information is the difference between the first frequency and the second frequency, the first frequency is calculated by adding the difference to the second frequency.

In operation S930, the representative frequency of the continuation sinusoidal signal is restored using the first frequency and the second information.

The above exemplary embodiments of the present invention can be embodied as a computer program. The computer program may be stored in a computer readable recording medium, and executed using a general digital computer. Examples of the computer readable medium include a magnetic recording medium (a ROM, a floppy disk, a hard disc, etc.), or an optical recording medium (a CD-ROM, a DVD, etc.).

According to the above exemplary embodiments of the present invention, frequency changing is performed at the boundary between adjacent sections, thereby effectively performing encoding while using a minimal number of bits.

Also, since the trend in a frequency change can be determined based on an estimated parameter, phase estimation can be precisely performed using the frequencies of a signal, thereby improving sound quality.

Also, even if the difference between the frequencies of sinusoidal signals is large, only a small number of bits are needed, and thus, it is possible to increase a frequency threshold for differentiating a continuation sinusoidal signal and a birth sinusoidal signal from each other.

While this invention has been particularly shown and described with reference to exemplary embodiments thereof, it will be understood by those of ordinary skill in the art that various changes in form and details may be made therein without departing from the spirit and scope of the invention as defined by the appended claims.

What is claimed is:

1. A method of encoding a frequency of a sinusoidal signal divided into a plurality of sections, the method comprising:

extracting a continuation sinusoidal signal in a current section, which is a sinusoidal signal successive to a sinusoidal signal in a previous section;

changing a frequency of the continuation sinusoidal signal at a boundary between the current section and the previous section to a first frequency, based on a representative frequency of the continuation sinusoidal signal and a representative frequency of at least one sinusoidal signal which belongs to a section adjacent to the current section and is successive to the continuation sinusoidal signal;

changing a frequency of a previous sinusoidal signal at the boundary between the current section and the previous section to a second frequency, wherein the previous sinusoidal signal belongs to the previous section and is successive to the continuation sinusoidal signal; and encoding the first frequency, wherein the encoding the first frequency comprises calculating a difference between the first frequency and the second frequency.

2. The method of claim 1, wherein the changing the frequency of the previous sinusoidal signal comprising changing the frequency of the previous sinusoidal signal at the boundary between the current section and the previous section to the second frequency, based on a representative frequency of the previous sinusoidal signal and a representative frequency of at least one sinusoidal signal which belongs to a section adjacent to the previous section and is successive to the previous sinusoidal signal.

3. The method of claim 2, wherein the changing the frequency of the continuation sinusoidal signal comprises:

determining an estimated parameter representing a relationship between the representative frequency of the continuation sinusoidal signal and the representative frequency of the at least one sinusoidal signal which belongs to the section adjacent to the current section and is successive to the continuation sinusoidal signal; and calculating the first frequency based on the estimated parameter and the representative frequency of the continuation sinusoidal signal.

4. The method of claim 3, wherein the estimated parameter comprises a frequency gradient calculated by dividing a difference between the representative frequencies of the previous sinusoidal signal and the continuation sinusoidal signal by a number of samples within the current section.

5. The method of claim 3, wherein the estimated parameter comprises a frequency gradient calculated by dividing a difference between a representative frequency of a subsequent sinusoidal signal and the representative frequency of the continuation sinusoidal signal by a number of samples within the current section, and the subsequent sinusoidal signal belongs to a subsequent section adjacent to the current section and is successive to the continuation sinusoidal signal.

6. The method of claim 3, further comprising transmitting at least one of encoding mode information indicating an encoding method used to encode the representative frequency of the continuation sinusoidal signal, the difference between the first frequency and the second frequency, and the estimated parameter.

7. The method of claim 3, wherein the extracting the continuation sinusoidal signal comprises extracting a plurality of continuation sinusoidal signals from the current section, where the continuation sinusoidal signals are respectively successive to a plurality of sinusoidal signals in the previous section, and wherein the determining the estimated parameter comprises:

determining a plurality of estimated parameters which respectively correspond to the continuation sinusoidal signals; and determining a representative parameter that is to be commonly used for changing frequencies of the respective sinusoidal signals at the boundary based on the estimated parameters.

8. The method of claim 1, further comprising extracting sinusoidal signals from the current section by analyzing an audio signal, wherein the extracting the continuation sinusoidal signal comprises performing sinusoidal tracking on the extracted sinusoidal signals.

9. A computer readable recording medium having recorded thereon a computer program for executing the method of claim 1.

10. A method of decoding a representative frequency of a continuation sinusoidal signal in a current section, which is successive to a sinusoidal signal in a previous section, the method comprising:

obtaining first information and second information from an encoded audio signal, wherein the first information includes information regarding a first frequency that is a frequency of the continuation sinusoidal signal, which is changed at a boundary between the current section and the previous section, and the second information includes information regarding a relationship between the first frequency and the representative frequency;

calculating the first frequency based on the first information; and restoring the representative frequency based on the first frequency and the second information, wherein the first information is a difference between the first frequency and a second frequency that is a frequency of a previous sinusoidal signal, which is changed at the boundary, and the previous sinusoidal signal belongs to the previous section and is successive to the continuation sinusoidal signal.

11. The method of claim 10, wherein the second information comprises a frequency gradient calculated by dividing a difference between a representative frequency of the previous sinusoidal signal and the representative frequency of the continuation sinusoidal signal by a number of samples within the current section, and the previous sinusoidal signal belongs to the previous section and is successive to the continuation sinusoidal signal.

12. The method of claim 10, wherein the second information comprises a frequency gradient calculated by dividing the difference between a representative frequency of a subsequent sinusoidal signal and the representative frequency of the continuation sinusoidal signal by a number of samples within the current section, where the subsequent sinusoidal signal belongs to a subsequent section adjacent to the current section and is successive to the continuation sinusoidal signal.

13. A computer readable recording medium having recorded thereon a computer program for executing the method of claim 10.

14. An apparatus for encoding a frequency of a sinusoidal signal divided into a plurality of sections, the apparatus comprising:

a continuation sinusoidal signal extraction unit which extracts a continuation sinusoidal signal in a current section, which is a sinusoidal signal successive to a sinusoidal signal in a previous section;

a frequency changing unit which changes a frequency of the continuation sinusoidal signal at a boundary between the current section and the previous section to a first frequency, based on a representative frequency of the continuation sinusoidal signal and a representative frequency of at least one sinusoidal signal which belongs to a section adjacent to the current section and is successive to the continuation sinusoidal signal, and changes a frequency of a previous sinusoidal signal at the boundary between the current section and the previous section to a second frequency, wherein the previous sinusoidal signal belongs to the previous section and is successive to the continuation sinusoidal signal; and an encoding unit which encodes the first frequency, wherein the encoding unit comprises a difference calculating unit which calculates a difference between the first frequency and the second frequency, and wherein at least one of the continuation sinusoidal signal extraction unit, the frequency changing unit, and the encoding unit is implemented as a hardware component.

15. The apparatus of claim 14, wherein the frequency changing unit changes the frequency of the previous sinusoidal signal at the boundary between the current section and the previous section to the second frequency, based on a representative frequency of the previous sinusoidal signal and a representative frequency of at least one sinusoidal signal which belongs to a section adjacent to the previous section and is successive to the previous sinusoidal signal, wherein the previous sinusoidal signal belongs to the previous section and is successive to the continuation sinusoidal signal.

16. The apparatus of claim 15, wherein the frequency changing unit comprises:

a parameter determination unit which determines an estimated parameter representing a relationship between the representative frequency of the continuation sinusoidal signal and the representative frequency of the at least one sinusoidal signal which belongs to the section adjacent to the current section and is successive to the continuation sinusoidal signal; and a frequency calculating unit which calculates the first frequency based on the estimated parameter and the representative frequency of the continuation sinusoidal signal.

17. The apparatus of claim 16, wherein the estimated parameter comprises a frequency gradient calculated by dividing a difference between the representative frequency of the previous sinusoidal signal and the representative frequency of the continuation sinusoidal signal by a number of samples within the current section.

18. The apparatus of claim 16, wherein the estimated parameter comprises a frequency gradient calculated by dividing a difference between a representative frequency of a subsequent sinusoidal signal and the representative frequency of the continuation sinusoidal signal by a number of samples within the current section, and the subsequent sinusoidal signal belongs to a subsequent section adjacent to the current section and is successive to the continuation sinusoidal signal.

19. The apparatus of claim 16, further comprising a transmission unit which transmits at least one of encoding mode information indicating an encoding method used to encode the representative frequency of the continuation sinusoidal signal, the difference between the first frequency and the second frequency, and the estimated parameter.

20. The apparatus of claim 16, wherein the continuation sinusoidal signal extraction unit extracts a plurality of continuation sinusoidal signals from the current section, where the continuation sinusoidal signals are respectively successive to a plurality of sinusoidal signals in the previous section, and wherein the estimated parameter determination unit comprises:

a parameter generation unit which generates a plurality of estimated parameters which respectively correspond to the continuation sinusoidal signals; and a representative parameter determination unit which determines a representative parameter that is to be commonly used for changing frequencies of the respective sinusoidal signals at the boundary based on the estimated parameters.

21. The apparatus of claim 14, further comprising a sinusoidal signal extraction unit extracting sinusoidal signals from the current section by analyzing an audio signal, wherein the continuation sinusoidal signal extraction unit includes a sinusoidal tracking unit which performs sinusoidal tracking on the extracted sinusoidal signals.

22. An apparatus for decoding a representative frequency of a continuation sinusoidal signal in a current section, which is successive to a sinusoidal signal in a previous section, the apparatus comprising:

an information obtaining unit which obtains first information and second information from an encoded audio signal, wherein the first information includes information regarding a first frequency that is a frequency of the continuation sinusoidal signal, which is changed at a boundary between the current section and the previous section, and the second information includes information regarding a relationship between the first frequency and the representative frequency;

a frequency calculating unit which calculates the first frequency based on the first information; and a frequency restoring unit which restores the representative frequency based on the first frequency and the second information, wherein the first information is a difference between the first frequency and a second frequency that is a frequency of a previous sinusoidal signal, which is changed at the boundary, and the previous sinusoidal signal belongs to the previous section and is successive to the continuation sinusoidal signal, and wherein at least one of the information obtaining unit, the frequency calculating unit, and the frequency restoring unit is implemented as a hardware component.

23. The apparatus of claim 22, wherein the second information comprises a frequency gradient calculated by dividing a difference between a representative frequency of the previous sinusoidal signal and the representative frequency of the continuation sinusoidal signal by a number of samples within the current section, and the previous sinusoidal signal belongs to the previous section and is successive to the continuation sinusoidal signal.

24. The apparatus of claim 22, wherein the second information comprises a frequency gradient calculated by dividing a difference between a representative frequency of a subsequent sinusoidal signal and the representative frequency of the continuation sinusoidal signal by a number of samples within the current section, and the subsequent sinusoidal signal belongs to a subsequent section adjacent to the current section and is successive to the continuation sinusoidal signal.

* * * * *